US011054127B2

(12) United States Patent
Jergensen

(10) Patent No.: US 11,054,127 B2
(45) Date of Patent: Jul. 6, 2021

(54) LIGHTING DEVICE

(71) Applicant: CarJamz, Inc., Ringwood, IL (US)

(72) Inventor: Steven Jergensen, Ringwood, IL (US)

(73) Assignee: CarJamz Com, Inc., Ringwood, IL (US)

( * ) Notice: Subject to any disclaimer, the term of this patent is extended or adjusted under 35 U.S.C. 154(b) by 0 days.

(21) Appl. No.: 17/002,406

(22) Filed: Aug. 25, 2020

(65) Prior Publication Data

US 2021/0102695 A1 Apr. 8, 2021

Related U.S. Application Data

(63) Continuation of application No. 16/591,793, filed on Oct. 3, 2019, now Pat. No. 10,801,714.

(51) Int. Cl.

| | |
|---|---|
| ***F21V 29/83*** | (2015.01) |
| ***F21V 19/02*** | (2006.01) |
| ***F21V 29/89*** | (2015.01) |
| ***F21V 19/00*** | (2006.01) |
| ***F21Y 115/10*** | (2016.01) |

(52) U.S. Cl.

CPC ..... *F21V 29/83* (2015.01); *F21V 19/0015* (2013.01); *F21V 19/0035* (2013.01); *F21V 19/02* (2013.01); *F21V 29/89* (2015.01); *F21Y 2115/10* (2016.08)

(58) Field of Classification Search

None

See application file for complete search history.

(56) References Cited

U.S. PATENT DOCUMENTS

| | | | |
|---|---|---|---|
| 5,947,587 | A | 9/1999 | Keuper et al. |
| 6,013,988 | A | 1/2000 | Bucks et al. |
| 6,016,038 | A | 1/2000 | Mueller et al. |
| 6,094,014 | A | 7/2000 | Bucks et al. |
| 6,127,783 | A | 10/2000 | Pashley et al. |
| 6,147,458 | A | 11/2000 | Bucks et al. |
| 6,150,774 | A | 11/2000 | Mueller et al. |
| 6,157,093 | A | 12/2000 | Giannopoulos et al. |
| 6,166,496 | A | 12/2000 | Lys et al. |

(Continued)

OTHER PUBLICATIONS

LED KITS Silver-Lux, #280H13, Putco.
G5 New Concert Design LED 3200LUMENS.

*Primary Examiner* — Britt D Hanley
(74) *Attorney, Agent, or Firm* — The Law Offices of Konrad Sherinian LLC

(57) ABSTRACT

An improved lighting device includes a tower body, a pair of parallel PCBs attached to the tower body, a connector and a set of wires connecting the connector and the PCBs. The wires are wrapped inside a RF shielding and disposed inside a supply cable. Each PCB includes two arrays of LEDs. Each array of LEDs includes three LEDs. A set of omni-directional heat sinks are attached to the base of the tower body. Each sink includes a set of tinned stranded copper ropes. The copper ropes each have a free end. The lighting device further includes a plug metal retention nut attached to the connector, a ratcheting inner collar attached to the tower body, and a mounting collar. The mounting collar has tabs, a ratchet mechanism having a series of troughs spaced by approximately one millimeter, and two guidance grooves. The mounting collar is couple with the ratcheting inner collar.

17 Claims, 14 Drawing Sheets

(56) References Cited

U.S. PATENT DOCUMENTS 6,194,839 B1 2/2001 Chang
6,201,353 B1 3/2001 Chang et al.
6,211,626 B1 4/2001 Lys et al.
6,234,645 B1 5/2001 Borner et al.
6,234,648 B1 5/2001 Borner et al.
6,249,088 B1 6/2001 Chang
6,250,774 B1 6/2001 Begemann et al.
6,292,901 B1 9/2001 Lys et al.
6,304,464 B1 10/2001 Jacobs et al.
6,340,864 B1 1/2002 Wacyk
6,340,868 B1 1/2002 Lys et al.
6,384,545 B1 5/2002 Lau
6,411,046 B1 6/2002 Muthu
6,441,558 B1 8/2002 Muthu et al.
6,445,139 B1 9/2002 Marshall et al.
6,459,919 B1 10/2002 Lys et al.
6,478,453 B2 11/2002 Lammers et al.
6,495,964 B1 12/2002 Muthu et al.
6,507,158 B1 1/2003 Wang
6,507,159 B2 1/2003 Muthu
6,510,995 B2 1/2003 Muthu et al.
6,513,949 B1 2/2003 Marshall et al.
6,528,954 B1 3/2003 Lys et al.
6,552,495 B1 4/2003 Chang
6,554,451 B1 4/2003 Keuper
6,561,690 B2 5/2003 Balestriero et al.
6,577,080 B2 6/2003 Lys et al.
6,577,512 B2 6/2003 Tripathi et al.
6,580,309 B2 6/2003 Jacobs et al.
6,586,890 B2 7/2003 Min et al.
6,596,977 B2 7/2003 Muthu et al.
6,608,453 B2 8/2003 Morgan et al.
6,609,813 B1 8/2003 Showers et al.
6,617,795 B2 9/2003 Bruning
6,621,235 B2 9/2003 Chang
6,630,801 B2 10/2003 Schuurmans
6,636,003 B2 10/2003 Rahm et al.
6,639,368 B2 10/2003 Sheoghong
6,676,284 B1 1/2004 Wynne Willson
6,692,136 B2 2/2004 Marshall et al.
6,720,745 B2 4/2004 Lys et al.
6,724,159 B2 4/2004 Gutta et al.
6,734,639 B2 5/2004 Chang et al.
6,741,351 B2 5/2004 Marshall et al.
6,762,562 B2 7/2004 Leong
6,777,891 B2 8/2004 Lys et al.
6,788,011 B2 9/2004 Mueller et al.
6,793,374 B2 9/2004 Begemann
6,796,680 B1 9/2004 Showers et al.
6,801,003 B2 10/2004 Schanberger et al.
6,806,659 B1 10/2004 Mueller et al.
6,831,569 B2 12/2004 Wang et al.
6,853,150 B2 2/2005 Clauberg et al.
6,853,151 B2 2/2005 Leong et al.
6,922,022 B2 7/2005 Bucks et al.
6,930,452 B2 8/2005 De Krijger et al.
6,932,477 B2 8/2005 Stanton
6,933,685 B2 8/2005 Gutta et al.
6,965,205 B2 11/2005 Piepgras et al.
6,967,448 B2 11/2005 Morgan et al.
6,969,954 B2 11/2005 Lys
6,972,525 B2 12/2005 Bucks et al.
6,975,079 B2 12/2005 Lys et al.
6,989,807 B2 1/2006 Chiang
6,992,803 B2 1/2006 Chang
6,998,594 B2 2/2006 Gaines et al.
7,014,336 B1 3/2006 Ducharme et al.
7,030,572 B2 4/2006 Nijhof et al.
7,031,920 B2 4/2006 Dowling et al.
7,038,398 B1 5/2006 Lys et al.
7,038,399 B2 5/2006 Lys et al.
7,064,498 B2 6/2006 Dowling et al.
7,067,992 B2 6/2006 Leong et al.
7,071,762 B2 7/2006 Xu et al.
7,118,248 B2 10/2006 Wynne Willson
7,132,804 B2 11/2006 Lys et al.
7,135,824 B2 11/2006 Lys et al.
7,139,617 B1 11/2006 Morgan et al.
7,140,752 B2 11/2006 Ashdown
7,161,311 B2 1/2007 Mueller et al.
7,161,313 B2 1/2007 Piepgras et al.
7,161,556 B2 1/2007 Morgan et al.
7,178,941 B2 2/2007 Roberge et al.
7,180,252 B2 2/2007 Lys et al.
7,182,480 B2 2/2007 Kan
7,186,003 B2 3/2007 Dowling et al.
7,202,608 B2 4/2007 Robinson et al.
7,202,613 B2 4/2007 Morgan et al.
7,202,641 B2 4/2007 Claessens et al.
7,204,622 B2 4/2007 Dowling et al.
7,221,104 B2 5/2007 Lys et al.
7,228,190 B2 6/2007 Dowling et al.
7,231,060 B2 6/2007 Dowling et al.
7,233,115 B2 6/2007 Lys
7,233,831 B2 6/2007 Blackwell
7,242,152 B2 7/2007 Dowling et al.
7,253,566 B2 8/2007 Lys et al.
7,255,457 B2 8/2007 Ducharme et al.
7,255,458 B2 8/2007 Ashdown
7,256,554 B2 8/2007 Lys
7,262,559 B2 8/2007 Tripathi et al.
7,267,461 B2 9/2007 Kan et al.
7,274,160 B2 9/2007 Mueller et al.
7,300,192 B2 11/2007 Mueller et al.
7,308,296 B2 12/2007 Lys et al.
7,314,289 B2 1/2008 Montagne
7,319,298 B2 1/2008 Jungwirth et al.
7,323,676 B2 1/2008 Duijve
7,329,998 B2 2/2008 Jungwirth
7,344,279 B2 3/2008 Mueller et al.
7,348,604 B2 3/2008 Matheson
7,350,936 B2 4/2008 Ducharme et al.
7,352,138 B2 4/2008 Lys et al.
7,352,339 B2 4/2008 Morgan et al.
7,353,071 B2 4/2008 Blackwell et al.
7,354,172 B2 4/2008 Chemel et al.
7,358,679 B2 4/2008 Lys et al.
7,358,681 B2 4/2008 Robinson et al.
7,358,706 B2 4/2008 Lys
7,358,929 B2 4/2008 Mueller et al.
7,358,961 B2 4/2008 Zwanenburg
7,387,405 B2 6/2008 Ducharme et al.
7,394,210 B2 7/2008 Ashdown
7,420,335 B2 9/2008 Robinson et al.
7,423,387 B2 9/2008 Robinson et al.
7,427,840 B2 9/2008 Morgan et al.
7,432,668 B2 10/2008 Zwanenburg et al.
7,449,847 B2 11/2008 Schanberger et al.
7,453,217 B2 11/2008 Lys et al.
7,459,864 B2 12/2008 Lys
7,462,997 B2 12/2008 Mueller et al.
7,463,070 B2 12/2008 Wessels
7,482,565 B2 1/2009 Morgan et al.
7,482,567 B2 1/2009 Hoelen et al.
7,482,760 B2 1/2009 Jungwirth et al.
7,490,953 B2 2/2009 Holten et al.
7,490,957 B2 2/2009 Leong et al.
7,495,671 B2 2/2009 Chemel et al.
7,502,034 B2 3/2009 Chemel et al.
7,504,781 B2 3/2009 Wendt et al.
7,507,001 B2 3/2009 Kit
7,511,436 B2 3/2009 Xu
7,511,437 B2 3/2009 Lys et al.
7,520,634 B2 4/2009 Ducharme et al.
7,520,636 B2 4/2009 Van Der Poel
7,521,872 B2 4/2009 Bruning
7,525,254 B2 4/2009 Lys et al.
7,538,499 B2 5/2009 Ashdown
7,542,257 B2 6/2009 McCormick et al.
7,550,931 B2 6/2009 Lys et al.
7,550,935 B2 6/2009 Lys et al.
7,557,521 B2 7/2009 Lys
7,569,807 B2 8/2009 Matheson
7,572,028 B2 8/2009 Mueller et al.

(56) References Cited

U.S. PATENT DOCUMENTS 7,573,209 B2 8/2009 Ashdown et al.
7,573,210 B2 8/2009 Ashdown et al.
7,573,729 B2 8/2009 Elferich et al.
7,598,681 B2 10/2009 Lys et al.
7,598,684 B2 10/2009 Lys et al.
7,598,686 B2 10/2009 Lys et al.
7,619,370 B2 11/2009 Chemel et al.
7,631,985 B1 12/2009 Knoble et al.
7,635,957 B2 12/2009 Tripathi et al.
7,652,236 B2 1/2010 Cortenraad et al.
7,652,237 B2 1/2010 Schulz
7,658,506 B2 1/2010 Dowling
7,654,703 B2 2/2010 Kan et al.
7,656,100 B2 2/2010 Deurenberg et al.
7,659,673 B2 2/2010 Lys
7,659,674 B2 2/2010 Mueller et al.
7,665,883 B2 2/2010 Matheson
7,667,409 B2 2/2010 Geerts et al.
7,675,238 B2 3/2010 Cortenraad et al.
7,687,753 B2 3/2010 Ashdown
7,688,002 B2 3/2010 Ashdown et al.
7,689,130 B2 3/2010 Ashdown
7,703,951 B2 4/2010 Piepgras et al.
7,710,369 B2 5/2010 Dowling
7,712,926 B2 5/2010 Matheson
7,714,521 B2 5/2010 Qian
7,719,209 B2 5/2010 Hayes
7,731,387 B2 6/2010 Cortenraad et al.
7,731,389 B2 6/2010 Draganov et al.
7,731,390 B2 6/2010 Van Gorkom et al.
7,737,643 B2 6/2010 Lys
7,738,002 B2 6/2010 Ashdown et al.
7,764,026 B2 7/2010 Dowling et al.
7,766,489 B2 8/2010 Duine et al.
7,766,518 B2 8/2010 Piepgras et al.
7,772,787 B2 8/2010 Ashdown et al.
7,777,427 B2 8/2010 Stalker, III
7,781,979 B2 8/2010 Lys
7,791,289 B2 9/2010 Oosterbaan et al.
7,802,902 B2 9/2010 Moss et al.
7,806,558 B2 10/2010 Williamson
7,808,191 B2 10/2010 Wu
7,809,448 B2 10/2010 Lys et al.
7,810,974 B2 10/2010 Van Rijswick et al.
7,828,465 B2 11/2010 Roberge et al.
7,845,823 B2 12/2010 Mueller et al.
7,854,539 B2 12/2010 Van Duijneveldt
7,866,845 B2 1/2011 Man
7,868,562 B2 1/2011 Salsbury et al.
7,878,683 B2 2/2011 Logan et al.
7,878,688 B2 2/2011 Paulussen et al.
7,893,631 B2 2/2011 Speier
7,893,661 B2 2/2011 Ackermann et al.
7,906,917 B2 3/2011 Tripathi et al.
7,911,118 B2 3/2011 Rooymans
7,911,151 B2 3/2011 Xu
7,914,173 B2 3/2011 Paulussen et al.
7,950,825 B2 5/2011 Cheng et al.
7,959,320 B2 6/2011 Mueller et al.
7,961,113 B2 6/2011 Rabiner et al.
7,980,726 B2 7/2011 Joosen et al.
7,982,414 B2 7/2011 Van Erp
7,986,103 B2 7/2011 Geerts et al.
7,988,327 B1 8/2011 Knoble et al.
7,988,328 B2 8/2011 Cheng et al.
7,999,484 B2 8/2011 Jurngwirth et al.
8,013,281 B2 9/2011 Morgan et al.
8,013,533 B2 9/2011 De Rijck et al.
8,016,459 B2 9/2011 Cheng et al.
8,022,632 B2 9/2011 Schulz et al.
8,026,673 B2 9/2011 Lys
8,035,313 B2 10/2011 Wendt et al.
8,047,696 B2 11/2011 Ijzerman et al.
8,047,699 B2 11/2011 Cheng et al.
8,063,577 B2 11/2011 Sauerlaender et al.
8,063,750 B2 11/2011 Knibbe
8,067,898 B2 11/2011 Radermacher et al.
8,070,328 B1 12/2011 Knoble et al.
8,076,872 B2 12/2011 Sauerlander et al.
8,076,953 B2 12/2011 Snelten
8,084,945 B2 12/2011 Deppe et al.
8,106,599 B2 1/2012 Radermacher et al.
8,115,410 B2 2/2012 Baaijens et al.
8,120,279 B2 2/2012 Oosterbaan et al.
8,134,303 B2 3/2012 Lys
8,134,461 B2 3/2012 Van Doorn
8,159,155 B2 4/2012 Deurenberg et al.
8,159,454 B2 4/2012 Radermacher et al.
8,174,210 B2 5/2012 Delnoij
8,183,784 B2 5/2012 Willaert et al.
8,203,284 B2 6/2012 Peeters et al.
8,207,821 B2 6/2012 Roberge et al.
8,212,393 B2 7/2012 Verschueren
8,212,494 B2 7/2012 Veltman
8,217,587 B2 7/2012 Sauerlaender
8,220,958 B2 7/2012 Montagne
8,240,900 B2 8/2012 Van Rijswick et al.
8,242,710 B2 8/2012 Radermacher et al.
8,246,200 B2 8/2012 Lai et al.
8,246,212 B2 8/2012 Schaefer et al.
8,258,707 B2 9/2012 Van Der Veen et al.
8,258,713 B2 9/2012 Deppe et al.
8,262,272 B2 9/2012 Cheng et al.
8,267,549 B2 9/2012 Hwang et al.
8,287,150 B2 10/2012 Schaefer et al.
8,288,957 B2 10/2012 Willaert
8,292,471 B2 10/2012 Boonekamp et al.
8,317,371 B1 11/2012 Khosrow et al.
8,330,387 B2 12/2012 York et al.
8,330,391 B2 12/2012 Wendt et al.
8,356,904 B2 1/2013 Van Doorn
8,368,315 B2 2/2013 Gaines et al.
8,378,591 B2 2/2013 Van Herpen et al.
8,390,207 B2 3/2013 Dowling et al.
8,400,071 B2 3/2013 Gaines et al.
8,408,741 B2 4/2013 Logan et al.
8,410,723 B2 4/2013 Deurenberg et al.
8,412,354 B2 4/2013 Deixler et al.
8,427,721 B2 4/2013 Vinkenvleugel et al.
8,434,897 B2 5/2013 Logan et al.
8,456,089 B2 6/2013 Deppe et al.
8,466,627 B2 6/2013 Radermacher
8,491,161 B2 7/2013 Marinus et al.
8,493,004 B2 7/2013 Sauerlaender
8,523,389 B2 9/2013 Holten et al.
8,552,659 B2 10/2013 Ashdown et al.
8,575,786 B2 11/2013 Verschueren
8,602,621 B2 12/2013 Li et al.
8,628,220 B2 1/2014 Boonekamp et al.
8,672,519 B2 3/2014 Schaefer et al.
8,692,656 B2 4/2014 Schulz et al.
8,729,454 B2 5/2014 Hilgers
8,770,787 B2 7/2014 Vissenberg et al.
8,807,765 B2 8/2014 van Doorn
8,816,602 B2 8/2014 Van Doorn
8,816,611 B2 8/2014 Vinkenvleugel
8,820,972 B2 9/2014 Mollnow et al.
8,829,812 B2 9/2014 Veltman
8,938,468 B2 1/2015 Morgan et al.
8,939,605 B2 1/2015 Snijder et al.
9,060,398 B2 6/2015 Deppe et al.
9,069,341 B2 6/2015 Robinson et al.
9,111,822 B2 8/2015 Speier
9,151,469 B2 10/2015 Jouffrieau et al.
9,243,796 B1 1/2016 Elwell et al.
9,368,071 B2 6/2016 Otte et al.
9,429,279 B2 8/2016 Dowling et al.
9,433,051 B2 8/2016 Snijder et al.
9,474,134 B2 10/2016 Knibbe
9,995,473 B2 6/2018 Elwell et al.
2014/0063829 A1* 3/2014 Kushalappa ..... F21S 41/151
362/508

(56) References Cited

U.S. PATENT DOCUMENTS

| | | | | |
|---|---|---|---|---|
| 2017/0023226 | A1* | 1/2017 | Elwell | F21S 41/192 |
| 2018/0023795 | A1* | 1/2018 | Elwell | F21S 41/141<br>362/249.02 |
| 2019/0017684 | A1* | 1/2019 | Xie | F21S 41/192 |

* cited by examiner

LIGHTING DEVICE

CROSS REFERENCE TO RELATED APPLICATIONS

This application is a continuation of U.S. patent application Ser. No. 16/591,793, entitled, "LIGHTING DEVICE," filed Oct. 3, 2019, which is hereby incorporated by reference in its entirety.

FIELD OF THE DISCLOSURE

The present invention generally relates to lighting devices, and more particularly relates to an automotive lighting device. More particularly still, the present disclosure relates to a new automotive lighting device incorporating a set of heat sinks including copper ropes and arrays of triple LEDs on printed circuit boards.

DESCRIPTION OF BACKGROUND

The automotive lighting industry has been moving away from incandescent bulb use for many years for improved performance, efficiency, and sustainability. The use of High-Intensity Discharge (HID) and Light Emitting Diode (LED) lighting devices has become more prevalent in the market, bringing down costs and ensuring sustained growth. However, these advancements in the automotive present new problems requiring new solutions. Regarding LED lighting options specifically, modern designs and production processes have led to performance and efficiency gains leading to a technology comparable, and in some cases, superior to that of alternatives. There are a few problems with the technology that have yet to be overcome, as well as many areas which can be further improved upon.

The first problem is poor heat management. LEDs produce light at a fraction of the energy expenditure of alternatives. However, this comes at the cost of heat production by a product that has a high level of heat sensitivity. LEDs require a cooling solution, whether active or passive, the intensity of which being dependent on the power usage. In conventional designs, heat is usually dispelled either through the primary metal assembly, sets of braided loops extending from the base of the assembly, or the use of a fan. The first two options are passive cooling solutions, relying on the natural transfer of heat through a medium. They are feasible solutions. However, there are drawbacks and limitations on their ability to cool the diodes. By using a fan, the third solution is an active cooling solution, using the movement of air to draw heat from the assembly. While also operational, fans require additional power consumption, have innate limitations in their ability to cool due to the small size required, and increase the complexity of the lighting device, and introduce another potential point-of-failure requiring maintenance/replacement.

The second problem is lower electrical reliability: LEDs are small devices which produce light in response to an electric current. As light is produced, heat is generated. The heat can damage or destroy an LED if not properly managed. However, damage can also occur to the Printed Circuit Board (PCB) and its components. In order to supply power to the boards, copper or aluminum wire must be attached to pads on the PCB using solder. Solder is a combination of metals and additives which allow for a low melting point and high bonding strength. The heat generated by LEDs, if not properly managed, can liquify solder and thus cause a failure of the electronic system.

The third problem is lower mechanical reliability. As automotive products, LED bulbs are used in the natural environment and will be exposed to the elements thereof. This results in the natural deterioration of the components used to build these products. LED bulbs usually use certain plastic components. Plastic is a material which degrades over time which, in combination with mechanical stresses, can result in fracturing of the material and component failure. Choices can be made in how key components of the product are designed, however, to remedy and prolong this inevitability to some degree.

The fourth problem is poor customization. The automotive industry attempts to serve a market consisting of hundreds of vehicle models with a limited number of lighting bulb designs. This invariably leads to a problem where a lighting device product, which fits 90% of vehicles with a certain socket type, does not match a small variation in 10% of vehicles with that same socket. This usually manifests itself as a misaligned lighting bulb producing beams pointing in the wrong direction.

Another problem is high spatial requirements. Modern vehicle designs push to combat increasingly higher fuel costs. One method of doing this is by reducing weight. To reduce weight, vehicles are designed to be smaller and use their space more efficiently. This has led to cramped spaces in the engine compartment around the light assemblies. Many consumers have complained about bulky lighting devices that cannot fit in their vehicles. Even attempts to remedy this problem have not succeeded in doing so, with the solutions tending to be large and bulky on their own.

Accordingly, there is a need for a new automotive lighting device overcoming such problems of conventional lighting devices. The new lighting device is provided by taking into account the evolution of the modern automotive industry, or the variability therein.

SUMMARY OF THE DISCLOSURE

Generally speaking, pursuant to the various embodiments, the present disclosure provides a lighting device for automobiles. The lighting device includes a tower body having a front end and a base, a wire channel machined out of the base of the tower body, and a set of omni-directional heat sinks. Each omni-directional heat sink within the set of omni-directional heat sinks has a set of tinned stranded copper ropes. Each tinned stranded copper rope within the set of tinned stranded copper ropes has a free end. Each tinned stranded copper rope within the set of tinned stranded copper ropes includes a core wire and a set of heat dissipating wires twisted around said core wire in spiral. The lighting device also includes a set of heat sink channels machined out of the base of the tower body. Each omni-directional heat sink within the set of omni-directional heat sinks is attached to a corresponding heat sink channel within the set of heat sink channels respectively. The lighting device further includes two printed circuit boards attached to the front end of the town body. The two printed circuit boards are aligned in parallel and face away from each other. Each of the two printed circuit boards incorporates two light emitting diode arrays and four solder pads. Each light emitting diode array includes three light emitting diodes. In addition, the lighting device includes a printed circuit board retention plate adapted to attach the two printed circuit boards to the tower body. The printed circuit board retention plate has a high beam deflector providing an opening of 90 degrees. Moreover, the lighting device includes a connector including a connector alignment groove and a threading mechanism on an outer surface of the connector, a set of eight electrical wires connecting the connector at one end and the solder pads at the opposite end, and extending through the wire channel, a radio frequency shielding wrapping around the set of eight electrical wires, a supply cable enclosing the radio frequency shielding, and a plug metal retention nut attached to the connector. In a further implementation, the lighting device includes a ratcheting inner collar attached to the front end of the tower body and incorporating two ratchet tabs, and a mounting collar. The mounting collar incorporates three bulb base specific socket tabs, a ratchet mechanism having a series of troughs spaced by approximately one millimeter, and two guidance grooves. The mounting collar is adapted to couple with the ratcheting inner collar using the two guidance grooves. In a further implementation, the lighting device includes a plug strain relief attached to the supply cable, and a plug finger grip attached to the plug strain relief. The plug metal retention nut is made of alloy. The connector incorporates a threading mechanism and a connector alignment groove. The plug metal retention nut is attached to the connector via the threading mechanism, Each omni-directional heat sink within the set of omni-directional heat sinks is slotted to a corresponding heat sink channel within the set of heat sink channels respectively. The set of omni-directional heat sinks consists of four omni-directional heat sinks and the set of tinned stranded copper ropes consists four tinned stranded copper ropes in one implementation. In a different implementation, the set of omni-directional heat sinks consists of eight omni-directional heat sinks and the set of tinned stranded copper ropes consists two tinned stranded copper ropes. In one embodiment, the set of heat dissipating wires includes six heat dissipating wires. Each tinned stranded copper rope within the set of tinned stranded copper ropes has a length between eighty millimeters and ninety-five millimeters. In addition, each heat dissipating wire within the set of heat dissipating wires has a diameter between two and half millimeters and four and half millimeters. In one particular implementation, each tinned stranded copper rope within the set of tinned stranded copper ropes has a length of approximately eighty-five millimeters, and each heat dissipating wire within the set of heat dissipating wires has a diameter of approximately three millimeters. The plug metal retention nut further incorporates a ridge.

BRIEF DESCRIPTION OF THE DRAWINGS

Although the characteristic features of this disclosure will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

A person of ordinary skills in the art will appreciate that elements of the figures above are illustrated for simplicity and clarity, and are not necessarily drawn to scale. The dimensions of some elements in the figures may have been exaggerated relative to other elements to help understanding of the present teachings. Furthermore, a particular order in which certain elements, parts, components, modules, steps, actions, events and/or processes are described or illustrated may not be actually required. A person of ordinary skill in the art will appreciate that, for the purpose of simplicity and clarity of illustration, some commonly known and well-understood elements that are useful and/or necessary in a commercially feasible embodiment may not be depicted in order to provide a clear view of various embodiments in accordance with the present teachings.

DETAILED DESCRIPTION

Figure 1:
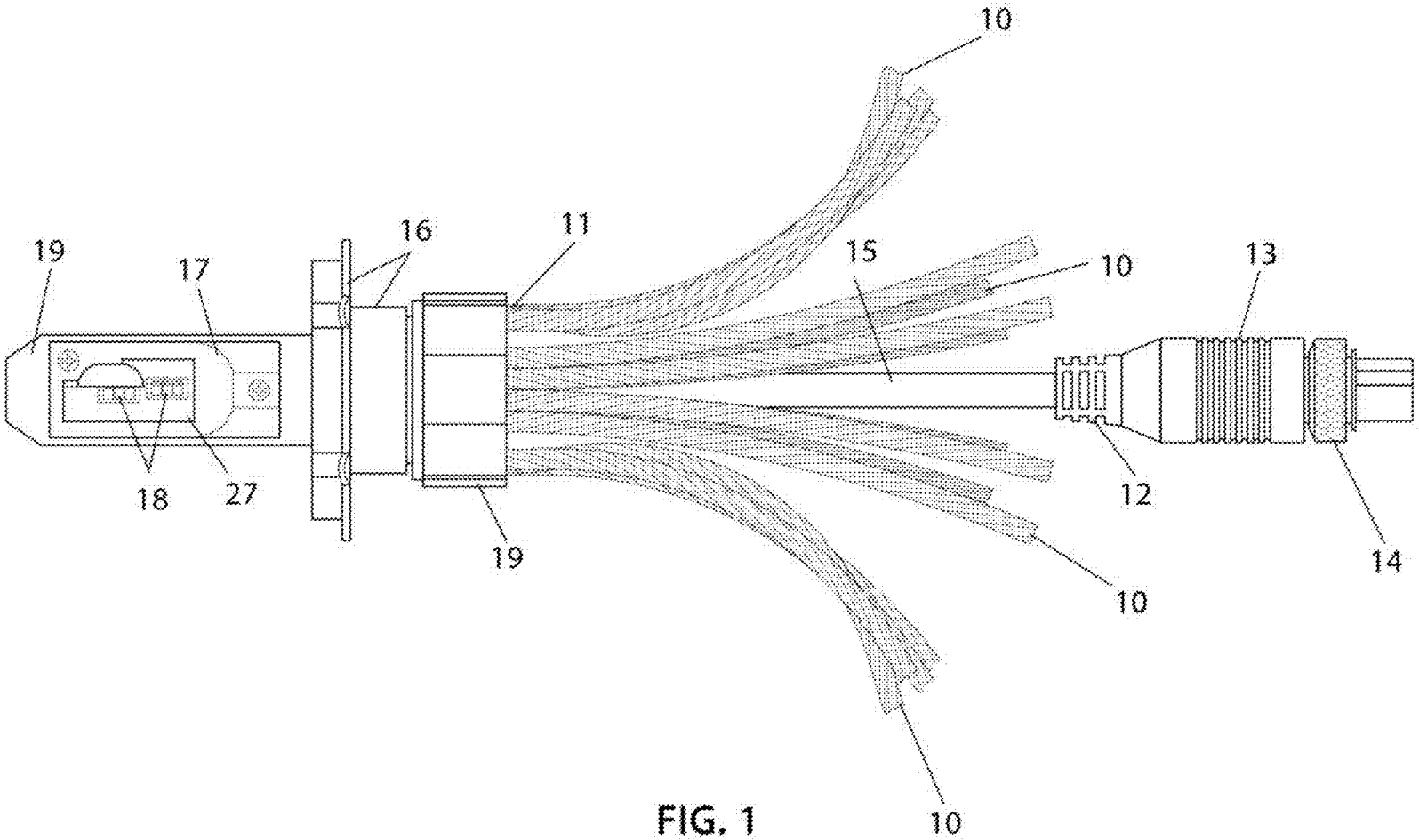
FIG. 1 is a top view of an improved lighting device in accordance with the teachings of this disclosure.

Turning to the Figures and to FIG. 1 in particular, a block diagram of the top view of an improved automotive lighting device is shown and generally indicated at 100. The lighting device 100 includes a tower body 19, four omni-directional heat sinks 11 mounted to the base of the tower body 19, a mounting collar 16, a pair of parallel PCBs 27 attached to the tower body 19 and each having a LED array socket 18, a supply cable 15 enclosing a set of electrical wires 31 (indicated in FIGS. 5, 6 and 10) for conducting electricity, a plug strain relief 12 wrapping around and attached to the supply cable 15, a plug finger grip 13 attached to the plug strain relief 12, a plug metal retention nut 14, a connector 35 and a connector alignment groove 36 disposed on the connector 35.

The connector 35 is connected to the electrical wires 31 disposed inside the supply cable 15. The plug metal retention nut 14 is screwed onto the inner end of the connector 35 via a threading mechanism. The plug metal retention nut 14 can also slide along the shaft. A ridge is present on the outer surface of the nut 14 to prevent loss of the retention nut 14. As the retention nut 14 is vital to maintaining a secure connection, it is important that the metal retention nut 14 does not fail. In one implementation, it is made of alloy, instead of a polymer, to ensure greater resistance to stress factors. The use of the retention nut 14 further eliminates failure due to vibration and thus maximizes product life expectancy.

One key area of failure of lighting devices in automobiles is the connection between the bulb and the ballast, or the LED driver circuitry. A conventional lighting device uses a male-to-female plug connection, a non-locking socket or a retention nut to secure the connection. However, the conventional designs use polymers for the connection component, and thus lead to low mechanical reliability. In the present teachings, the metal retention nut 14 and the metal threads on the connector 35, by which the nut 14 is coupled to the connector 35, eliminate the potential failure through material fracture due to natural weather exposure and driving conditions.

Figure 8A:
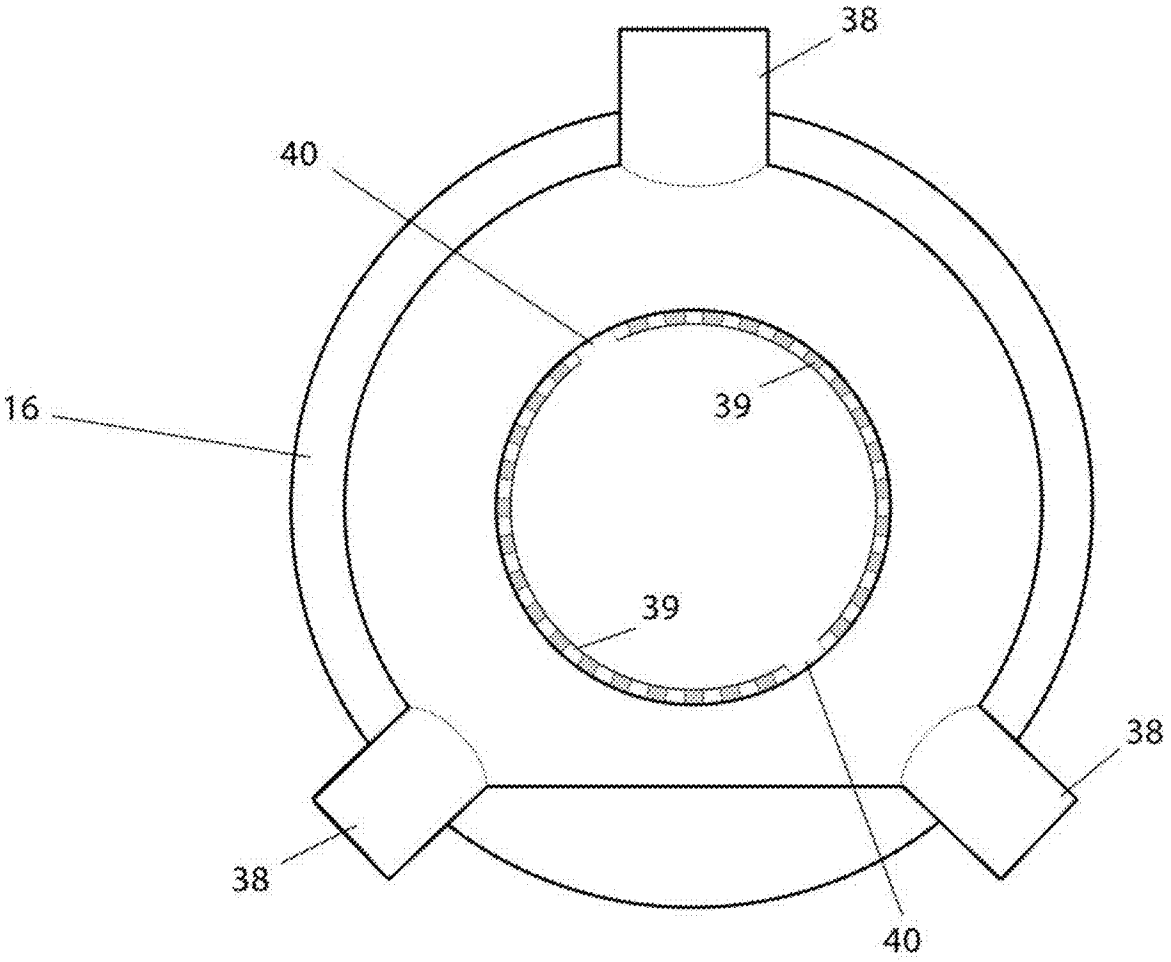
FIG. 8A is a rear view of a mounting collar of an improved lighting device in accordance with the teachings of this disclosure.
Figure 8B:
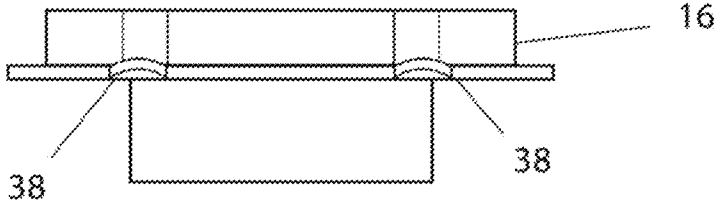
FIG. 8B is a side view of a mounting collar of an improved lighting device in accordance with the teachings of this disclosure.

The mounting collar 16 is further illustrated by reference to FIGS. 8A and 8B. Turning to FIGS. 8A and 8B, a rear view of the mounting collar 16 is shown in FIG. 8A while a side view of it is shown in FIG. 8B. The mounting collar 16 incorporates three bulb base specific socket tabs 38, a ratchet mechanism 39 having a series of small troughs, and a pair of guidance grooves 40. In one implementation, the troughs of the ratchet mechanism 39 are spaced from each other by approximately 1 mm.

Figure 2:
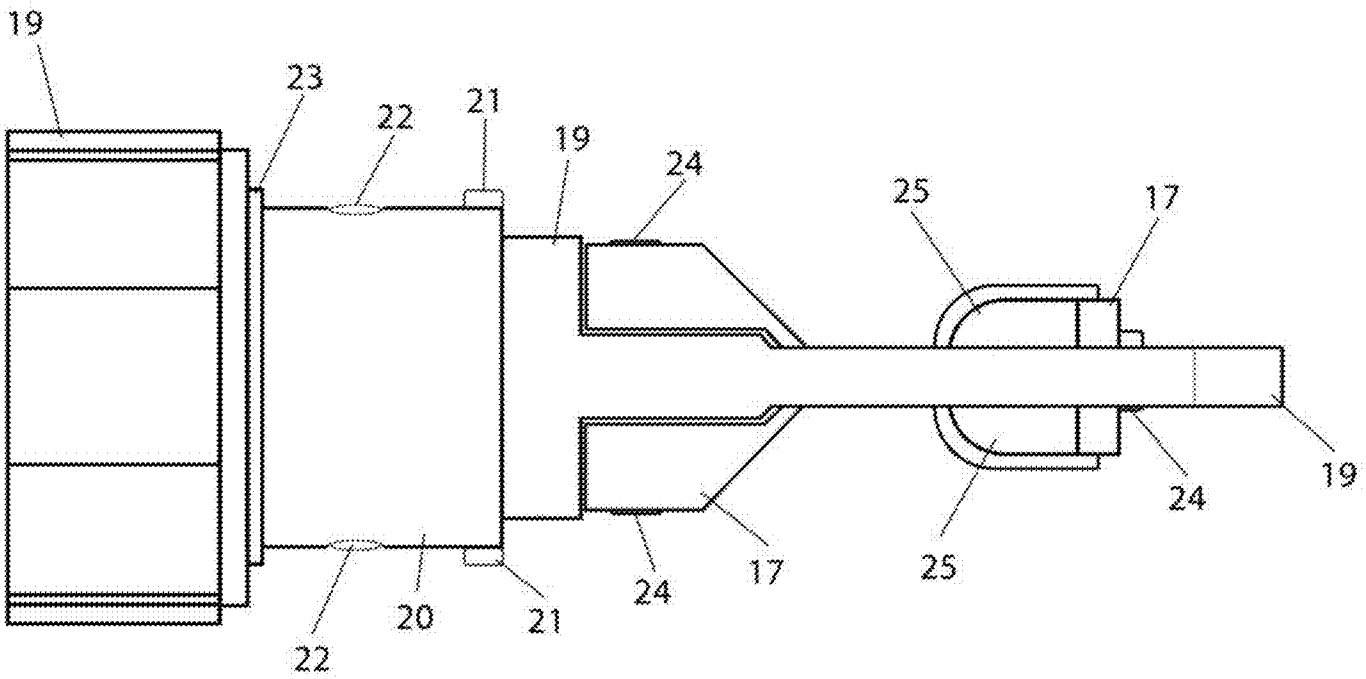
FIG. 2 is a partial side view of an improved lighting device in accordance with the teachings of this disclosure.

The mounting collar 16 slides around a 360-degree ratcheting inner collar 20 using the two guidance grooves 40. The ratcheting inner collar 20 is further illustrated by reference to FIG. 2. Referring now to FIG. 2, a partial side view of the improved lighting device 100 is shown. The ratcheting inner collar 20 slides around the tower body 19. The ratcheting inner collar 20 incorporates two ratchet tabs 21 that are machined into the ratcheting inner collar 20 on two opposite sides. The two ratchet tabs 21 aid with assembly by sliding through the guidance grooves 40.

The ratcheting mechanism 39 is designed with no moving parts by being machined directly into both the mounting collar 16 and the ratcheting collar 20 that are attached to the tower body 19 using two ratcheting inner collar screws 22. The ratcheting inner collar screw 22 is received by the ratchet collar screw hole 34 (indicated in FIG. 5). The small spacing between the troughs of the ratchet mechanism 39 provides more positions than conventional lighting devices. In one implementation, the ratchet mechanism 39 provides 29 troughs. The bulb can be set in 22 positions with 11 positions in either direction once installed. This configuration provides approximately 360° coverage with the exceptions being a) the two positions corresponding with the guidance grooves, and b) the limitations of the ratcheting mechanism's resolution (meaning the number of positions in a full 360°).

In one implementation, the percentage of coverage is approximately 45.83% due to the gaps between troughs (resolution) and the two guidance grooves, or 91.66% coverage when resolution is not taken into account. These percentages are figured based on only troughs, with the gaps excluded in the equations. However, they would be roughly the same, or slightly lower when the gaps are factored in.

Figure 9A:
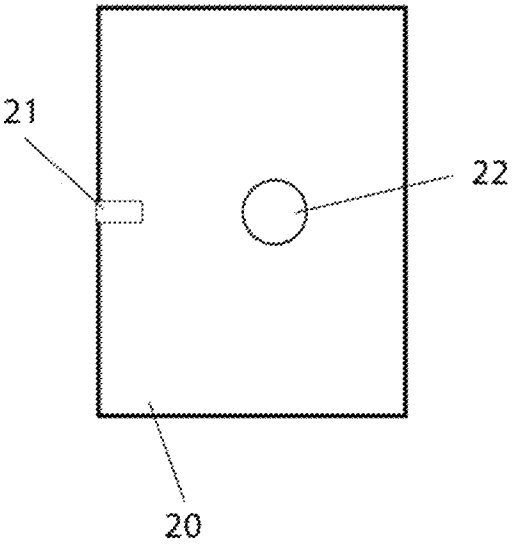
FIG. 9A is a top view of a ratcheting collar of an improved lighting device in accordance with the teachings of this disclosure.
Figure 9B:
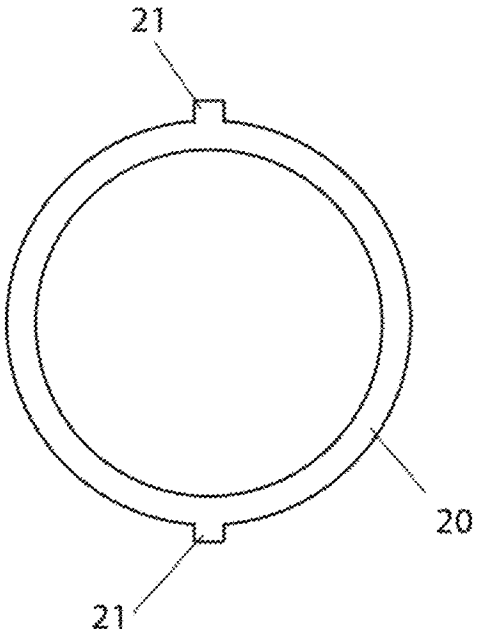
FIG. 9B is a front view of a ratcheting collar of an improved lighting device in accordance with the teachings of this disclosure.
Figure 9C:
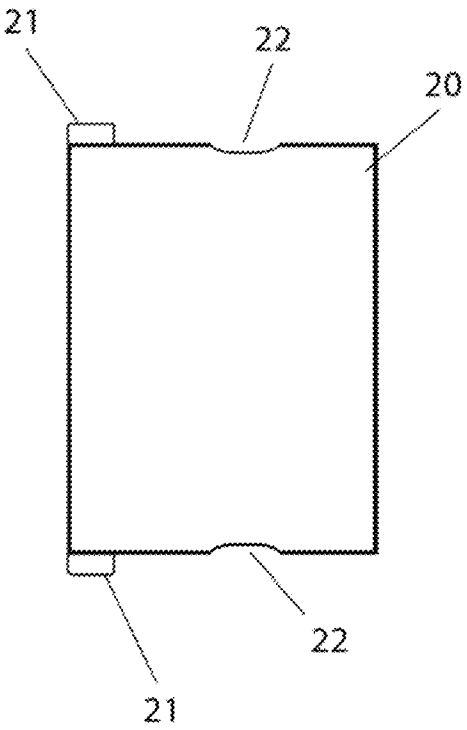
FIG. 9C is a side view of a ratcheting collar of an improved lighting device in accordance with the teachings of this disclosure.

The adjustability provided by the ratcheting mechanism 39 is superior to conventional lighting devices. Conventional lighting devices lack adjustable systems, or use different adjustable systems with different mechanisms that provide as few as 2 beam positions. Below the mounting collar 16 is an O-ring 23, which provides support and required pressure against the collar 16 to ensure the ratcheting mechanism has a safe and secure fit. The ratcheting collar 20, the two ratchet tabs 21, and the two ratcheting inner collar screws 22 are further illustrated in FIGS. 9A, 9B and 9C.

Figure 7:
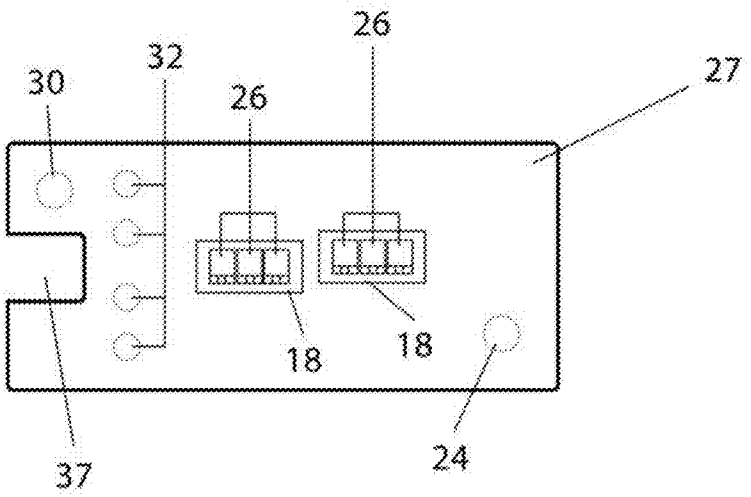
FIG. 7 is a top view of a printed circuit board of an improved lighting device in accordance with the teachings of this disclosure.

The two PCBs 27 are further illustrated by reference to FIG. 7. Referring now to FIG. 7, a block diagram of the top view of the PCB 27 is shown. The PCB 27 includes two LED arrays 18. Each LED socket 18 includes three LEDs 26. Each of the PCBs 27 also includes four solder pads 32, a PCB screw hole 30, a PCB alignment notch 37, and a PCB retention plate screw hole 24. The PCBs 27 are attached to the front end of the tower body 19 using a screw running through the PCB retention plate screw hole 24. The PCB alignment notches 37 of the PCBs 27 receive an alignment block 33 (indicated in FIG. 5) to ensure proper alignment. The alignment block 33 is machined out of the tower body 19.

Figure 10:
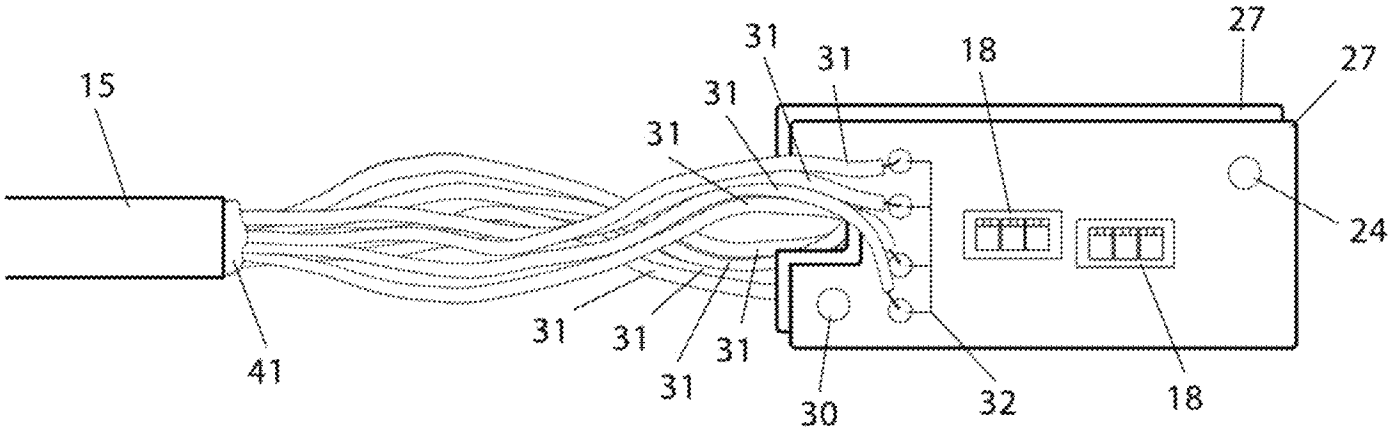
FIG. 10 is a partial top view of an improved lighting device in accordance with the teachings of this disclosure.
Figure 11:
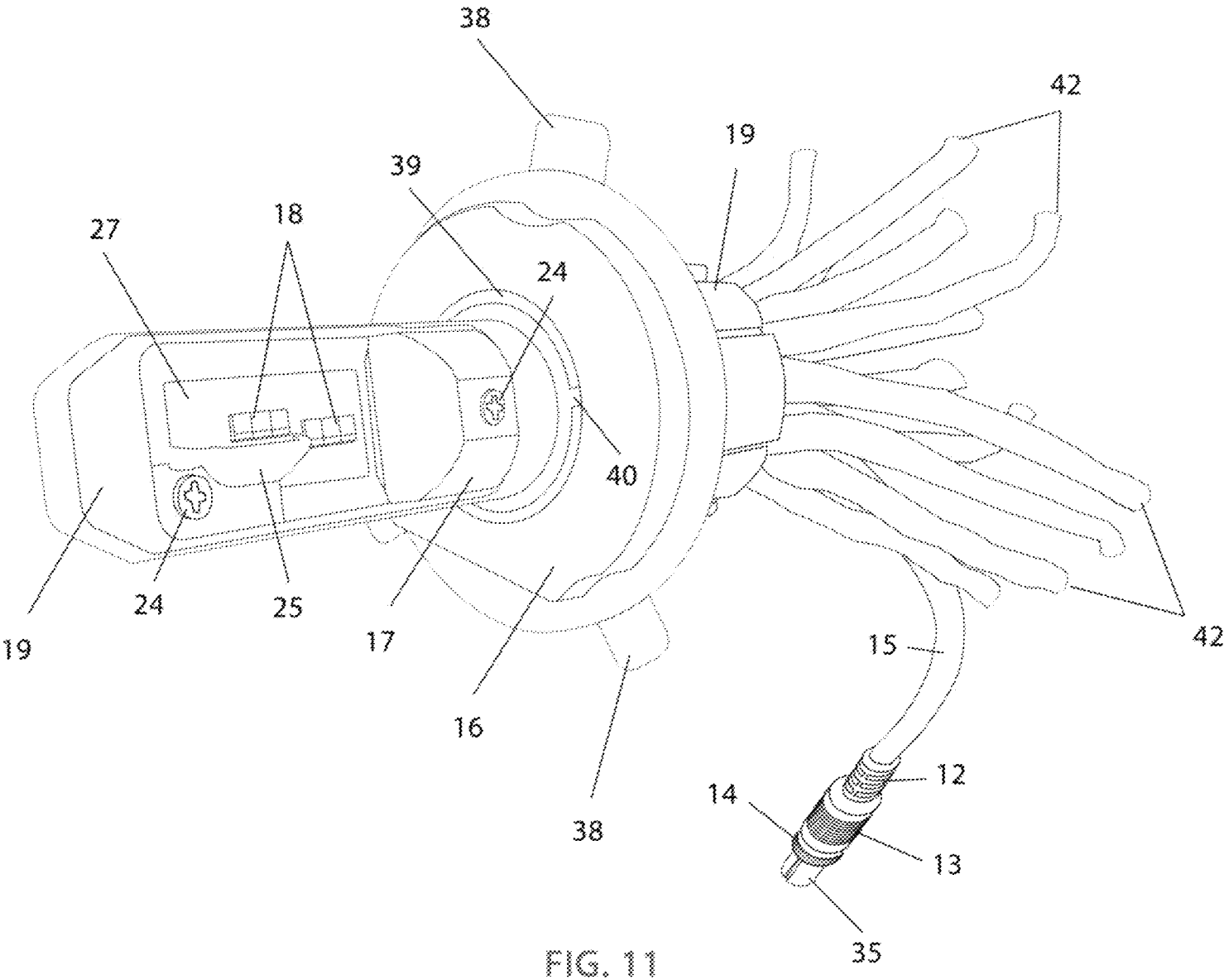
FIG. 11 is a front perspective view of an improved lighting device in accordance with the teachings of this disclosure.

The PCBs 27 are further illustrated by reference to FIGS. 3, 4, 5, 6 and 10. Turning first to FIG. 10, a partial view of the lighting device 100 is shown. The two PCBs 27 are parallel to each other and attached to the tower body 19 at the same location. Four separate electrical power supply wires 31 are attached to each PCB 27 using the solder pads 32. The eight wires 31 are wrapped in a Radio Frequency (RF) shielding 41 to prevent radio frequency interference, and disposed inside the supply cable 15.

Figure 4:
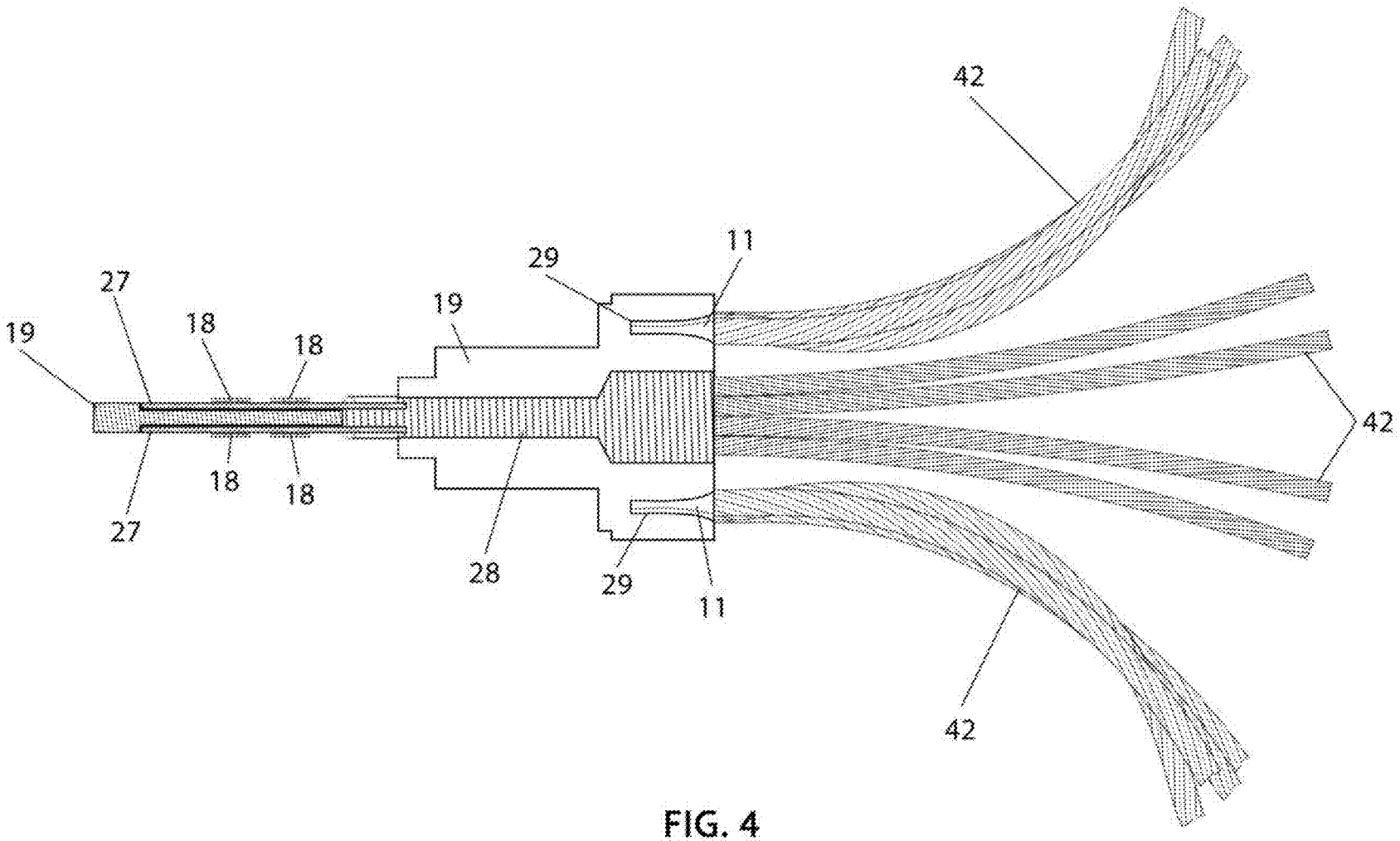
FIG. 4 is a partial side view of an improved lighting device in accordance with the teachings of this disclosure.
Figure 6:
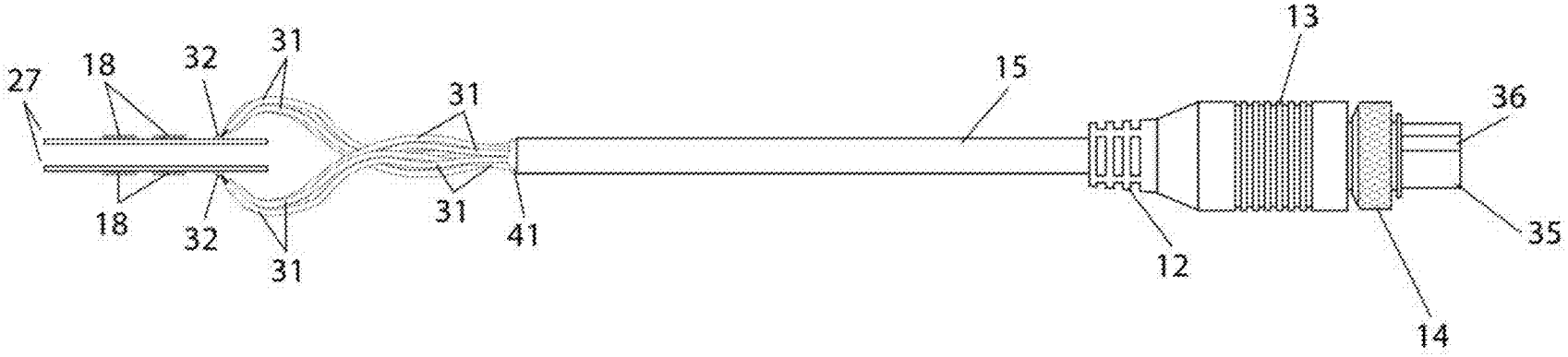
FIG. 6 is a partial side view of an improved lighting device in accordance with the teachings of this disclosure.

FIGS. 4 and 6 provide partial side views of the new lighting device 100. The two PCBs 27 face each other and are attached to the tower body 19. The wires 31 run through a wire channel 28 machined out of the base of the tower body 19. Four heat sink channels 29 are also machined out of the base of the tower body 19 (two of which are indicated in FIG. 4). In one embodiment, the four channels 29 are evenly spaced in the base of the tower body 19. Four omni-directional heat sinks 11 attached to the four heat sink channels 29 respectively. For instance, the sinks 11 are slotted into the channels 29. In a different implementation, eight heat sink channels are machined out of the base of the tower body 19 and distributed around the base of the tower body 19. Eighty omni-directional heat sinks are attached to the eight heat sink channels respectively. Each of the eight omni-directional heat sinks includes one, two or more tinned and stranded copper ropes.

Each of the sinks 11 includes four tinned stranded copper ropes 42. In one implementation, each rope 42 includes seven wires with a single core wire surrounded by six wires twisted in spiral; the length of the ropes 42 is between 80 mm and 95 mm; the diameter of each wire of the rope 42 is between 2.5 mm and 4.5 mm. One optimal configuration has the length of approximately 85 mm and the diameter of approximately 3 mm. One end of the copper ropes 42 is not connected or attached to any other elements. Accordingly, the sinks 11 and the ropes 42 are said to be hanging from the tower body 19 and have a free end. The copper ropes 42 are not loops. The loose end of them is not a loop either.

The present teaching provides a two-fold approach to efficiently manage heat released by the LEDs 26. First, the improved lighting device 100 incorporates sixteen tinned and stranded copper ropes 42 to provide much greater surface area for heat to disperse. The increased surface leads to quicker cooling than the conventional lighting devices. One conventional approach is to incorporate a braided loop for dispersing heat. However, the braided loop traps heat and thus leads to lower efficiency in heat dispersion. Second, the present teachings incorporate two triple emitter LED arrays 18 on each PCB 27. Each array 18 hosts three LEDs 26. The array of three diodes with a total combined power consumption equal to that of a traditional array containing two diodes allows for each diode to produce less heat and slightly less light individually. However, the combined array will produce an equal or even greater light output, measured at 2650 Lux (a unit of illuminance and luminous emittance), with less heat generated overall.

Heat generated by lighting device 100 is dispersed more quickly than conventional solutions through the tower body 19 to the four omni-directional heat sinks 11 and the stranded copper rope 42. Therefore, the electrical components of the lighting device 100 are subjected to less heat stress, thus increasing their expected lifespan. The quicker heat dispersion of the improved lighting device 100 improves its electrical reliability.

Figure 3:
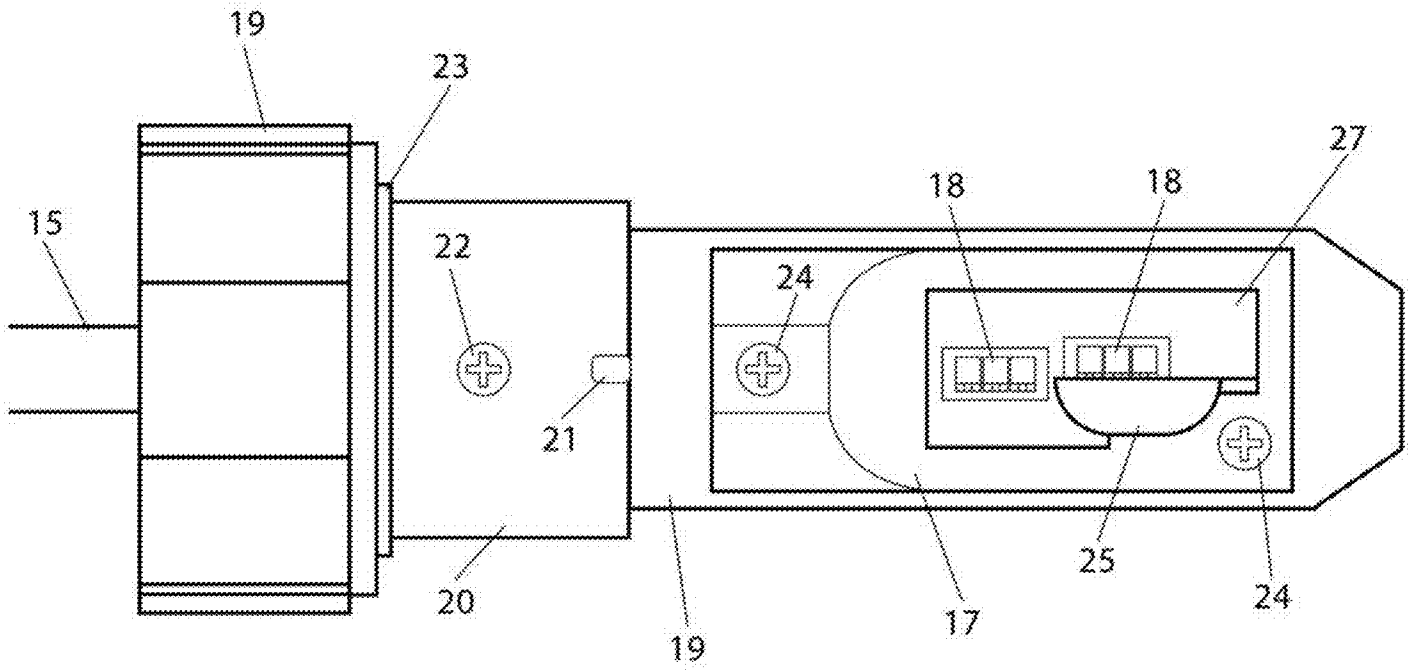
FIG. 3 is a partial top view of an improved lighting device in accordance with the teachings of this disclosure.
Figure 5:
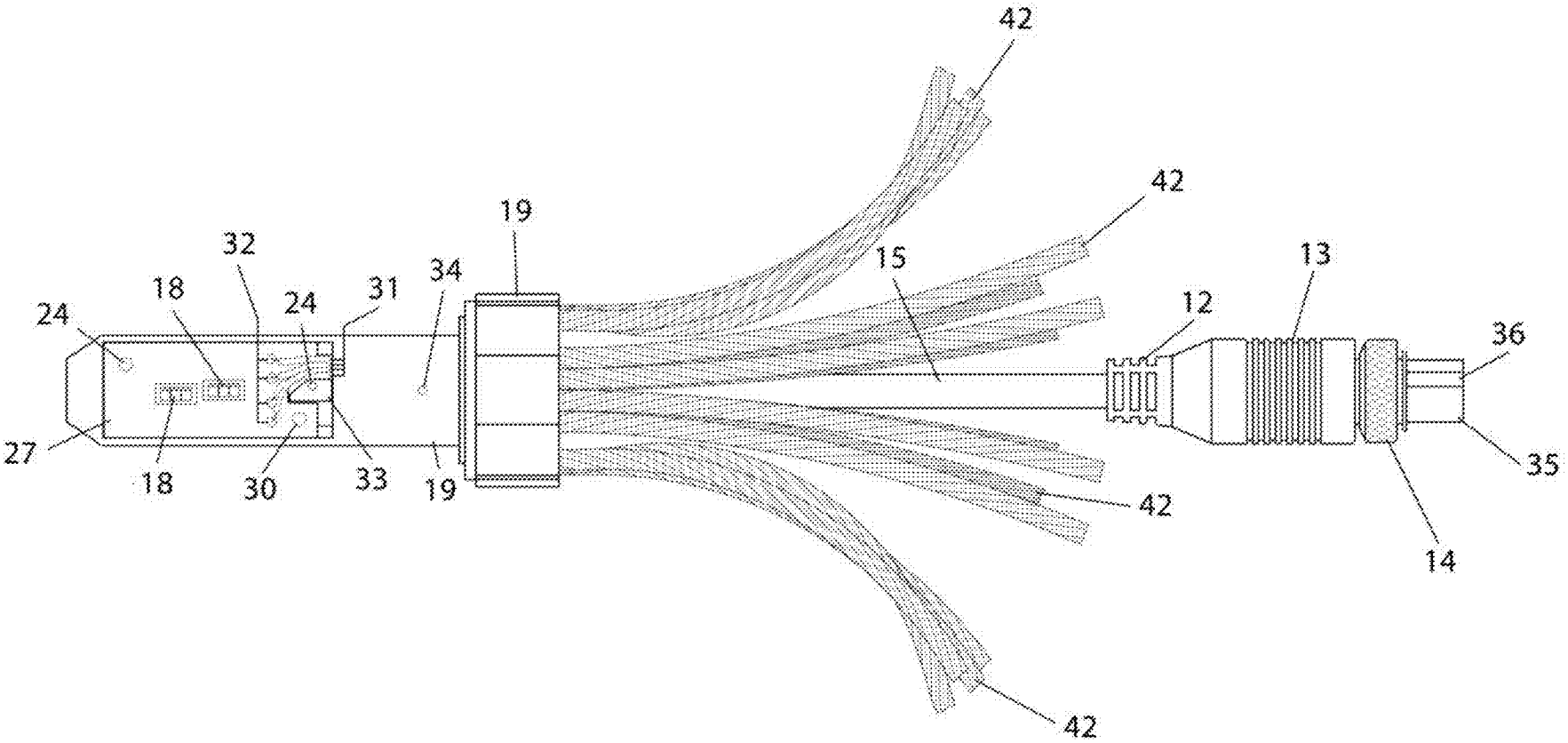
FIG. 5 is a partial top view of an improved lighting device in accordance with the teachings of this disclosure.

FIG. 5 shows a top view of the lighting device 100 without the mounting collar 16 shown. FIG. 3 is a partial top view of the lighting device 100. The lighting device 100 includes a PCB retention plate 17 for attaching the PCB 27 to the tower body 19. Each PCB retention plate 17 contains a high beam deflector 25. The plate 17 and the deflector 25 are further illustrated in FIG. 2. The high beam deflector 25 provides an opening of 90 degrees for improved focus projection.

Each PCB 27 incorporates two arrays 18 of three LEDs, instead of the conventional 2×2 design. The lighting device 100 thus reduces heat production, lengthens component life expectancy, and improves power efficiency. The back surface of each PCB 27 is attached to the front end of the tower body 19. Accordingly, the heat generated by the LEDs 26 can dissipate and travel down to the omni-directional heat sink 11 and the copper ropes 42 from the tower body 19. Using the tower body 19 as a part of the heat path provides additional cooling efficiency. Each heat sink 11 is made of four tinned stranded copper ropes 42. The total of sixteen free end copper ropes 42 is an improvement over traditional two to four braided loops by increasing surface area for better cooling. The free end copper ropes 42 also provides easier vehicle fitment versus the conventional solutions as the ropes 42 can rotate in all directions and take up much less space.

In one implementation, the plug strain relief 12 and the plug finger grip 13 are integrally formed. The strain-relief 12 helps to prevent deterioration of the supply cable 15, and the finger grips 13 for safety and ease of installation and removal. In one implementation, the supply cable 15 is flexible and made of, for example, rubber or other types of flexible material. Alternative, the supply cable 15 can be made of more rigid materials. The supply cable 15 serves as an insulator.

As numerous automobile makers each produce various models of vehicles, a solution is highly desired to allow for customization regarding fitment of aftermarket vehicle lighting devices. The most prominent problem with the lighting device is the poor angle of projection, or improper direction of beam projection due to light fixture variation. The present teachings provide a new solution to the problem in a simple and direct approach. The mounting collar 20, along with the tower body 19 which allows for mounting into a vehicle light fixture, incorporates the 360-degree ratcheting-grooves 39 and the ratchet tab 21. Accordingly, the direction of the beam from the lighting device 100 can be adjusted by turning the collar 20 to the correct position allowing the beam to maintain a focused position. The adjustment can be made after installation, but prior to making cable connections. The ability for customization is highly desired out of lighting devices.

Due to the increasingly limited amount of engine compartment space in modern vehicles, lighting solutions need to become smaller and less bulky. The present teachings incorporate a set of four omni-directional heat sinks 11. Each sink 11 includes tinned and stranded copper ropes 42 in groupings of four. The number of sinks 11 in the set of sinks 11 can be a different number, such as two. The number of ropes 42 in each sink 11 can be a different number as well, such as two. The ropes 42 each have a free end. They can also be bent, twisted, and curved in 360-degrees into very small spaces. This allows for the lighting device 100 to be mounted in tight areas where traditional braided loop and fan designs would be unable to fit without affecting the ability to disperse heat due to congestion.

Obviously, many additional modifications and variations of the present disclosure are possible in light of the above teachings. Thus, it is to be understood that, within the scope of the appended claims, the disclosure may be practiced otherwise than is specifically described above.

The foregoing description of the disclosure has been presented for purposes of illustration and description, and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It should be recognized that the words "a" or "an" are intended to include both the singular and the plural. Conversely, any reference to plural elements shall, where appropriate, include the singular.

It is intended that the scope of the disclosure not be limited by the specification, but be defined by the claims set forth below. In addition, although narrow claims may be presented below, it should be recognized that the scope of this invention is much broader than presented by the claim (s). It is intended that broader claims will be submitted in one or more applications that claim the benefit of priority from this application. Insofar as the description above and the accompanying drawings disclose additional subject matter that is not within the scope of the claim or claims below, the additional inventions are not dedicated to the public and the right to file one or more applications to claim such additional inventions is reserved.

What is claimed is:

1. A lighting device for an automobile, said lighting device comprising:

1) a tower body having a front end and a base;
2) a wire channel machined out of said base of said tower body;
3) four omni-directional heat sinks, each of said four omni-directional heat sinks having four tinned stranded copper ropes respectively, each tinned stranded copper rope within said four tinned stranded copper ropes includes a core wire and six heat dissipating wires twisted around said core wire in spiral;
4) four heat sink channels machined out of said base of said tower body, said four omni-directional heat sinks slotted to said four heat sink channels respectively, each of said tinned stranded copper rope has a free end;
5) two printed circuit boards attached to said front end of said town body, said two printed circuit boards aligned in parallel and facing away from each other, each of said two printed circuit boards incorporating two light emitting diode arrays and four solder pads, each said light emitting diode array including three light emitting diodes;
6) a printed circuit board retention plate adapted to attach said two printed circuit boards to said tower body, said printed circuit board retention plate having a high beam deflector providing an opening of 90 degrees;

7) a connector including a connector alignment groove and a threading mechanism on an outer surface of said connector;

8) a set of eight electrical wires connecting said connector at one end and said solder pads at the opposite end, and extending through said wire channel;

9) a radio frequency shielding wrapping around said set of eight electrical wires;

10) a supply cable enclosing said radio frequency shielding;

11) a plug metal retention nut attached to said connector via said threading mechanism;

12) a plug strain relief attached to said supply cable;

13) a plug finger grip attached to said plug strain relief;

14) a ratcheting inner collar attached to said front end of said tower body and incorporating two ratchet tabs; and 15) a mounting collar incorporating three bulb base specific socket tabs, a ratchet mechanism having a series of troughs spaced by approximately one millimeter, and two guidance grooves, said mounting collar adapted to couple with said ratcheting inner collar using said two guidance grooves.

2. The lighting device of claim 1, wherein each tinned stranded copper rope within said four tinned stranded copper ropes has a length between eighty millimeters and ninety-five millimeters, and each of said six heat dissipating wires has a diameter between two and half millimeters and four and half millimeters.

3. The lighting device of claim 2, wherein each tinned stranded copper rope within said four tinned stranded copper ropes has a length of approximately eighty-five millimeters, and each of said six heat dissipating wires has a diameter of approximately three millimeters.

4. The lighting device of claim 1, wherein said plug metal retention nut incorporates a ridge.

5. The lighting device of claim 1, wherein said plug metal retention nut is made of alloy.

6. A lighting device for an automobile, said lighting device comprising:

1) a tower body having a front end and a base;

2) a wire channel machined out of said base of said tower body;

3) a set of omni-directional heat sinks, each omni-directional heat sink within said set of omni-directional heat sinks having a set of tinned stranded copper ropes, each tinned stranded copper rope within said set of tinned stranded copper ropes having a free end, each tinned stranded copper rope within said set of tinned stranded copper ropes includes a core wire and a set of heat dissipating wires twisted around said core wire in spiral;

4) a set of heat sink channels machined out of said base of said tower body, each omni-directional heat sink within said set of omni-directional heat sinks attached to a corresponding heat sink channel within said set of heat sink channels respectively;

5) two printed circuit boards attached to said front end of said town body, said two printed circuit boards aligned in parallel and facing away from each other, each of said two printed circuit boards incorporating two light emitting diode arrays and four solder pads, each said light emitting diode array including three light emitting diodes;

6) a printed circuit board retention plate adapted to attach said two printed circuit boards to said tower body, said printed circuit board retention plate having a high beam deflector providing an opening of 90 degrees;

7) a connector including a connector alignment groove and a threading mechanism on an outer surface of said connector 8) a set of eight electrical wires connecting said connector at one end and said solder pads at the opposite end, and extending through said wire channel;

9) a radio frequency shielding wrapping around said set of eight electrical wires 10) a supply cable enclosing said radio frequency shielding; and 11) a plug metal retention nut attached to said connector.

7. The lighting device of claim 6 further comprising:

1) a ratcheting inner collar attached to said front end of said tower body and incorporating two ratchet tabs; and 2) a mounting collar incorporating three bulb base specific socket tabs, a ratchet mechanism having a series of troughs spaced by approximately one millimeter, and two guidance grooves, said mounting collar adapted to couple with said ratcheting inner collar using said two guidance grooves.

8. The lighting device of claim 7 further comprising:

1) a plug strain relief attached to said supply cable; and 2) a plug finger grip attached to said plug strain relief.

9. The lighting device of claim 6, wherein said plug metal retention nut is made of alloy.

10. The lighting device of claim 6, wherein said connector incorporates a threading mechanism and a connector alignment groove, said plug metal retention nut attached to said connector via said threading mechanism.

11. The lighting device of claim 6, wherein each omni-directional heat sink within said set of omni-directional heat sinks is slotted to a corresponding heat sink channel within said set of heat sink channels respectively.

12. The lighting device of claim 6, wherein said set of omni-directional heat sinks consists of four omni-directional heat sinks and said set of tinned stranded copper ropes consists of four tinned stranded copper ropes.

13. The lighting device of claim 6, wherein said set of omni-directional heat sinks consists of eight omni-directional heat sinks and said set of tinned stranded copper ropes consists two tinned stranded copper ropes.

14. The lighting device of claim 6, wherein said set of heat dissipating wires includes six heat dissipating wires.

15. The lighting device of claim 6, wherein each tinned stranded copper rope within said set of tinned stranded copper ropes has a length between eighty millimeters and ninety-five millimeters, and each heat dissipating wire within said set of heat dissipating wires has a diameter between two and half millimeters and four and half millimeters.

16. The lighting device of claim 15, wherein each tinned stranded copper rope within said set of tinned stranded copper ropes has a length of approximately eighty-five millimeters, and each heat dissipating wire within said set of heat dissipating wires has a diameter of approximately three millimeters.

17. The lighting device of claim 6, wherein said plug metal retention nut incorporates a ridge.

* * * * *